US011771188B2

(12) United States Patent
Maurello et al.

(10) Patent No.: US 11,771,188 B2
(45) Date of Patent: Oct. 3, 2023

(54) DUAL SHADE APPARATUS

(71) Applicant: JRJ ALLIANCE, LLC, Oceanside, NY (US)

(72) Inventors: John M. Maurello, Oceanside, NY (US); John Michael Maurello, Oceanside, NY (US)

(73) Assignee: JRJ ALLIANCE, LLC, Oceanside, NY (US)

( * ) Notice: Subject to any disclaimer, the term of this patent is extended or adjusted under 35 U.S.C. 154(b) by 181 days.

(21) Appl. No.: 17/416,191

(22) PCT Filed: Jun. 26, 2019

(86) PCT No.: PCT/US2019/039348
§ 371 (c)(1),
(2) Date: Jun. 18, 2021

(87) PCT Pub. No.: WO2020/236198
PCT Pub. Date: Nov. 26, 2020

(65) Prior Publication Data

US 2022/0053896 A1 Feb. 24, 2022

(51) Int. Cl.

| | |
|---|---|
| ***A45B 23/00*** | (2006.01) |
| ***A45B 25/00*** | (2006.01) |
| ***A63B 57/00*** | (2015.01) |
| ***A45B 17/00*** | (2006.01) |
| *A45B 11/00* | (2006.01) |

(52) U.S. Cl.
CPC ..... *A45B 25/00* (2013.01); *A45B 17/00* (2013.01); *A45B 23/00* (2013.01); *A63B 57/00* (2013.01); *A45B 2011/005* (2013.01); *A45B 2023/005* (2013.01); *A45B 2023/0006* (2013.01); *A45B 2023/0031* (2013.01); *A45B 2023/0093* (2013.01); *A45B 2025/003* (2013.01)

(58) Field of Classification Search
CPC .. A45B 23/00; A45B 2023/0093; E04H 15/58
See application file for complete search history.

(56) References Cited

U.S. PATENT DOCUMENTS

| | | | | | |
|---|---|---|---|---|---|
| 4,524,405 | A * | 6/1985 | Heard | G03B 15/06 | 362/450 |
| 5,390,685 | A * | 2/1995 | McCoy | A45B 19/06 | 135/33.5 |
| 5,692,720 | A * | 12/1997 | Griggs | A45B 23/00 | 248/512 |
| 5,937,881 | A * | 8/1999 | Villa | A45B 23/00 | 135/21 |
| 5,947,138 | A * | 9/1999 | DeAngelis | A45B 11/00 | 135/25.1 |
| 6,899,388 | B1 * | 5/2005 | Enrique | A47C 9/105 | 297/16.2 |

(Continued)

*Primary Examiner* — Noah Chandler Hawk
(74) *Attorney, Agent, or Firm* — LAW OFFICES OF ALOZIE N. ETUFUGH PLLC; Alozie Etufugh, ESQ.

(57) ABSTRACT

The invention features a dual shade apparatus adapted to provide shade to an individual or individuals while the individual(s) is/are outside and in need of shade from sunlight. Aspects of embodiments of the present invention contemplate a dual shade apparatus that is easily portable and easily adapted to the sun's changing positions, thereby providing the individual(s)/user(s) with shade from sunlight.

14 Claims, 11 Drawing Sheets

(56) References Cited

U.S. PATENT DOCUMENTS

| | | | | |
|---|---|---|---|---|
| D533,207 | S * | 12/2006 | Kennedy | D16/244 |
| 7,172,168 | B1 * | 2/2007 | Kallas | E04H 12/2215 52/157 |
| 8,272,605 | B2 * | 9/2012 | Fuchs | F16B 7/1454 248/156 |
| 9,675,146 | B1 * | 6/2017 | Howell | A45B 23/00 |
| 2003/0226941 | A1 * | 12/2003 | Crain | F16B 7/1463 248/176.1 |
| 2007/0034342 | A1 * | 2/2007 | Fill | A45B 11/00 160/351 |
| 2007/0209688 | A1 * | 9/2007 | Earnshaw | A45B 23/00 248/689 |
| 2013/0240007 | A1 * | 9/2013 | Ashton | E04H 15/58 135/161 |

* cited by examiner

DUAL SHADE APPARATUS

FIELD OF THE INVENTION

The present invention relates, in general, to an adjustable shade apparatus having multiple applications such as sports, gardening, work outdoors etc.

BACKGROUND OF THE INVENTION

The inability to provide adequate shade while one is outside, is a reason why a good number of people do not engage in certain outdoor activities. The lack of shade also affects sporting performance of athletes and sportsmen as they engage in their respective sports. Existing shade systems such as umbrellas fail to address the ever changing needs of people working outside as the sun is constantly moving thus requiring a shade system that adapts with the changing position of the sun. As such, there is a need for an apparatus which is easily adaptable for providing shade to a person regardless of the sun's position. In addition, there is a need for a shade apparatus that is portable and adaptable for use and/or installation onto existing devices, structures and/or apparatuses. Further, there is a need for a shade apparatus that could the shading needs of more than one user at the same time.

SUMMARY OF THE INVENTION

The present invention contemplates a shade apparatus which is configured to provide an individual with shade regardless of the sun's position or the direction of its rays. The apparatus contemplates being able to be set at angles or positions at varying heights, angles, sides etc. all in an effort to shield the individual from the sun. As such, the sun's position would not matter as the apparatus may be easily adjusted to shield the individual.

An aspect of an embodiment of the present invention contemplates a shade apparatus which may include: a tripod arrangement which may include two front tripod legs, one rear tripod leg and a tripod base, where the tripod legs are foldably connected to the tripod base, a first junction connected to one tripod leg, where the first junction comprises of an opening, a first arm, having first and second ends, where the first arm is slidably positioned within the opening of the first junction, a second junction, where the second junction is connected to: the first arm, a first canvas arm and a connector arm, a third junction, where the third junction is connected to: the connector arm and a second canvas arm, and first and second canvas structures, where the first canvas structure is connected with the first canvas arm by way of a first canvas structure junction and where the second canvas arm is connected with the second canvas arm by way of a second canvas structure junction.

In an aspect of an embodiment of the present invention, any one of or more of the first, second or third junctions of the shade apparatus may be multi directional, multi axial, multi angular and multi rotational, capable of moving in multiple directions about different axes.

In an aspect of an embodiment of the present invention, the shade apparatus may include a hook removably connected to the rear tripod leg.

In an aspect of an embodiment of the present invention, any one of or more of the first, second or third junctions of the shade apparatus may include any one or a combination of: collar locks, lever cam locks, flat cam locks, rotational angle piece, where the rotational angle piece enables rotation of the any one or more of the first, second or third junctions.

In an aspect of an embodiment of the present invention, the tripod base of the shade apparatus may include one or more holders or holder compartments for holding user items.

In an aspect of an embodiment of the present invention, each tripod leg of the shade apparatus may include a tripod foot, where each tripod foot of each tripod leg could be any one of the following: distinct from each other, same as each other.

In an aspect of an embodiment of the present invention, the tripod foot may be made up of a sleeve for receiving the tripod foot's corresponding tripod leg, and a flat portion connected to the sleeve, where the flat portion is angularly connected with the sleeve.

In an aspect of an embodiment of the present invention, the sleeve and flat portions may be connected by way of at least one angular connector.

In an aspect of an embodiment of the present invention, any one or more of the shade apparatus' arms is a pole.

In an aspect of an embodiment of the present invention, the shade apparatus may include a scissor hinge connector, where the scissor connector connects any two sets of the tripod legs.

In an aspect of an embodiment of the present invention, the shade apparatus may include a support arm connected to the first arm and the first canvas arm. The support arm may provide additional support to the first canvas arm.

In an aspect of an embodiment of the present invention, any one or more of the first canvas structure junction, second canvas structure junction may be multi directional, multi axial, multi angular and multi rotational, capable of moving in multiple directions about different axes.

In an aspect of an embodiment of the present invention, any one or more of the first and second canvas structures may include a front portion, a mid-portion and a rear portion, where the front portion may be connected to the mid-portion by way of a first set of portion connectors and where the mid-portion may be connected to the rear portion by way of a second set of portion connectors and where the rear portion is correspondingly connected with the first, second canvas structure junction.

In an aspect of an embodiment of the present invention, each of any one or more of the first set of portion connectors, second set of portion connectors may include two scissor hinges which enable the mid-portion to be lifted away from or folded towards the front and rear portions.

In an aspect of an embodiment of the present invention, each of any one or more of the first set of portion connectors, second set of portion connectors comprises of two fixed arms the position the mid-portion away from the front and rear portions.

Additional aspects, objectives, features and advantages of the present invention will become apparent from the following description of the preferred embodiments with reference to the attached drawings. The invention has been described in detail with particular reference to certain preferred embodiments thereof, but it will be understood that variations and modifications can be effected within the spirit and scope of the invention.

DETAILED DESCRIPTION OF THE INVENTION

Figure 1A:
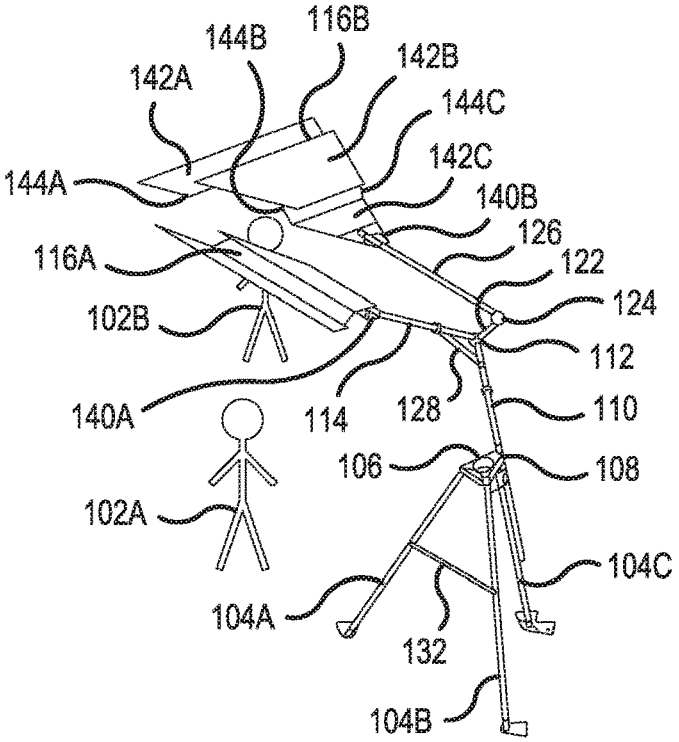
FIG. 1A-1D illustrate a shade apparatus having two canvas structures according to an aspect of an embodiment of the present invention.
Figure 1B:
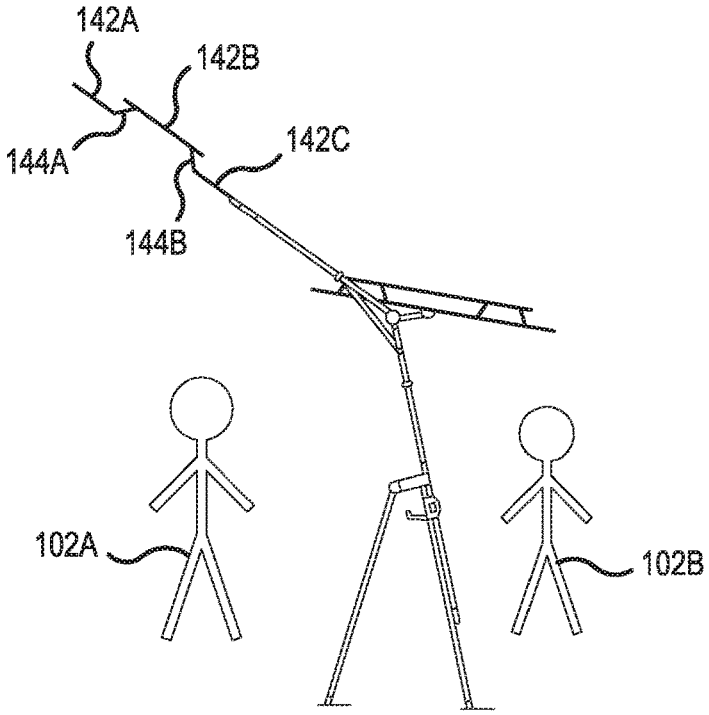
Figure 1C:
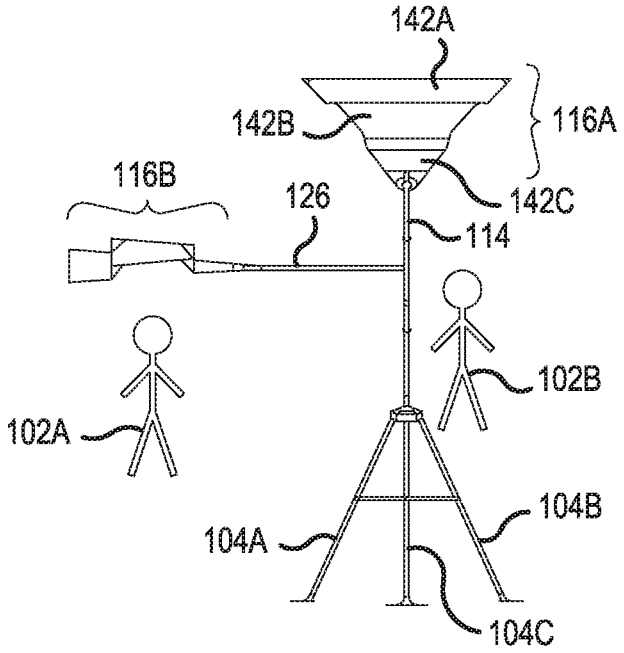
Figure 1D:
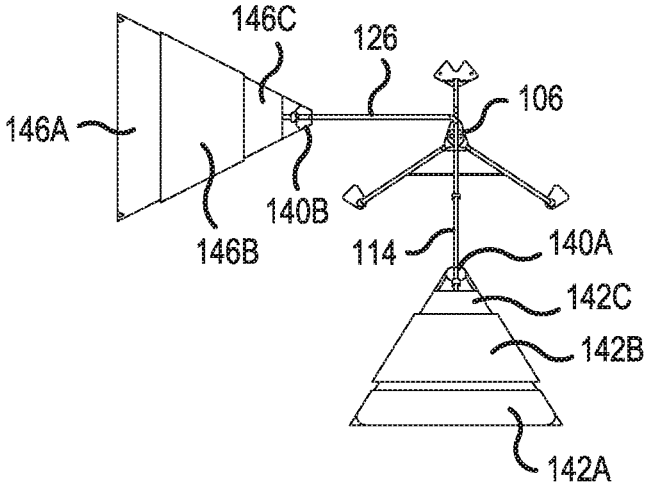
Figure 1E:
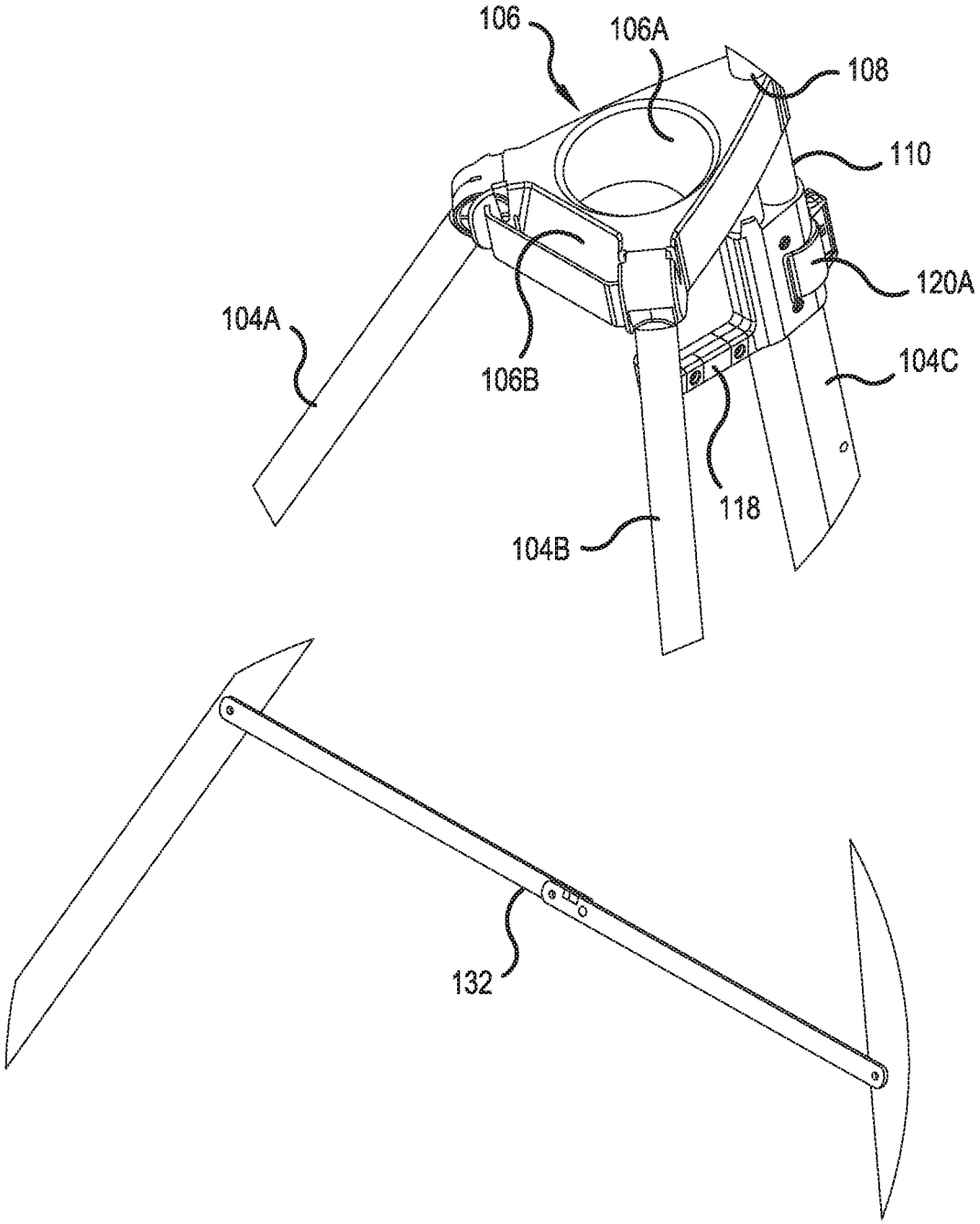
FIG. 1E illustrates the details of a tripod base of a shade apparatus according to an aspect of an embodiment of the present invention.
Figure 1F:
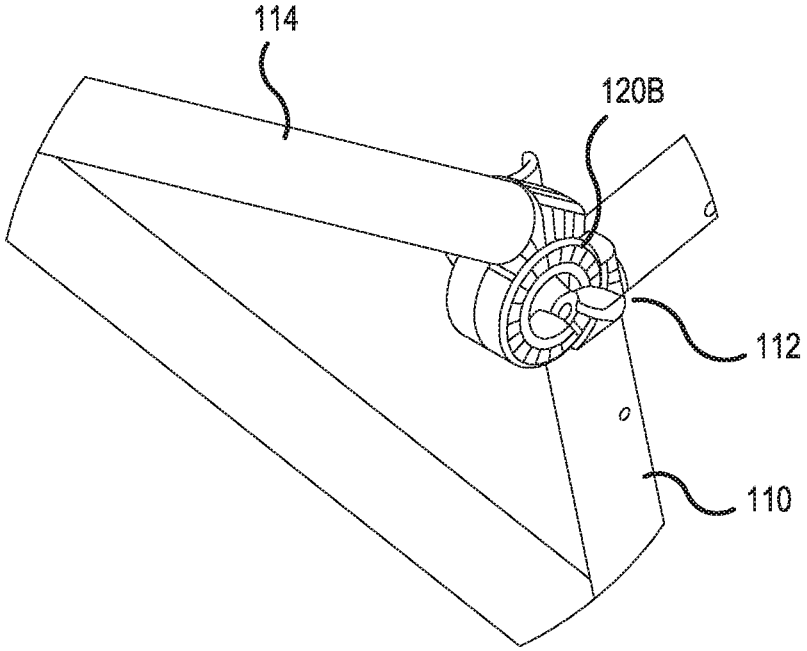
FIG. 1F illustrates the details of an elbow joint of a shade apparatus according to an aspect of an embodiment of the present invention.

Referring now to FIGS. 1A through 1F a shade apparatus 100 is shown according to aspect(s) of embodiment(s) of the present invention. Shade apparatus 100 is shown being used by players/users 102A and 102B engaged in an activity using shade apparatus 100 to generate shade (FIGS. 1A-1C). Shade apparatus 100 may include tripod legs 104A-104C which are used to position and stabilize shade apparatus 100 on the ground. Tripod legs 104A-104C may be connected to tripod base 106. In one aspect of an embodiment of the present invention, the connection of each of tripod legs 104A-104C may be characterized by a movable, adjustable, swivel joint at each connection enabling the folding of each leg for transport of shade apparatus 100 after use.

In another aspect of an embodiment of the present invention, legs 104A-104C may be telescopic, thereby enabling the shortening of each leg when any one of users 102A or 102B takes down and transports shade apparatus 100. In addition, tripod legs 104A-104C may include rubber caps at the base of each leg to generate friction with the ground/surface and prevent the legs from slipping.

In an aspect of an embodiment of the present invention, "arms" as described in this application may refer to, without limitation, rods, pole structures (i.e. an arm having a circular cross section) or structures having, without limitation, different cross sections e.g. parabolic, hexagonal, pentagonal etc. In other words, structures having any type of cross-sectional shape are also contemplated.

In another aspect of an embodiment of the present invention, each of the arms may be telescopic, having parts that may be in telescopic relationship with one another. This structural configuration aids in the adjustment of each arm by users 102A and/or 102B to attain the desired angle, length and/or height of the arm in question.

Tripod base 106 may further be connected to first junction 108. First junction 108 may, in one aspect of an embodiment of the present invention, serve as the holding or attachment mechanism for first arm 110. In an aspect, arm 110 may be slidably positioned within a sleeve of junction 108. This arrangement enables arm 110 to slide to a desired length within the sleeve of junction 108 when the user adjusts the height and/or angle of the shade produced by shade apparatus 100. Junction 108 may include locking mechanism 120A for locking arm 110 in place. In an aspect of an embodiment of the present invention, arm 110 may be rotatable about its axis.

In an aspect of an embodiment of the present invention, tripod base 106 may include one or more holders or holder compartments 106A and 106B. Holders 106A and 106B may serve to hold different things including, cups, keys, phones etc.

One end of arm 110 extends away from junction 108 to connect with second junction 112. Second junction 112 also acts as a connection junction for first canvas arm 114 of first canvas structure 116A. Second junction 112 may also, in an aspect of an embodiment of the present invention, include a locking mechanism 120B for locking first canvas arm 114 in a desired position or at a desired length. Locking mechanism 120B may also be released to enable adjustment of first canvas arm 114 in relation to junction 112. First canvas arm 114 may, in one aspect, be slidably positioned within a sleeve of second junction 112, with the arrangement enabling first canvas arm 114 slid to a desired length for adjusting the angle of the shade produced by first canvas structure 116A. In such an aspect, first canvas arm 114 fits into a sleeve of second junction 112—thus enabling first canvas arm 114 to be slid through such a sleeve to adjust its length or position.

In an aspect of an embodiment of the present invention, the end of arm 110 unconnected with junction 108 may feature rubber grip for ease of use and handling.

In an aspect of an embodiment of the present invention, first canvas structure 116A may include a canvas of any shape and rods used to maintain the desired shape of the canvas.

Figure 1G:
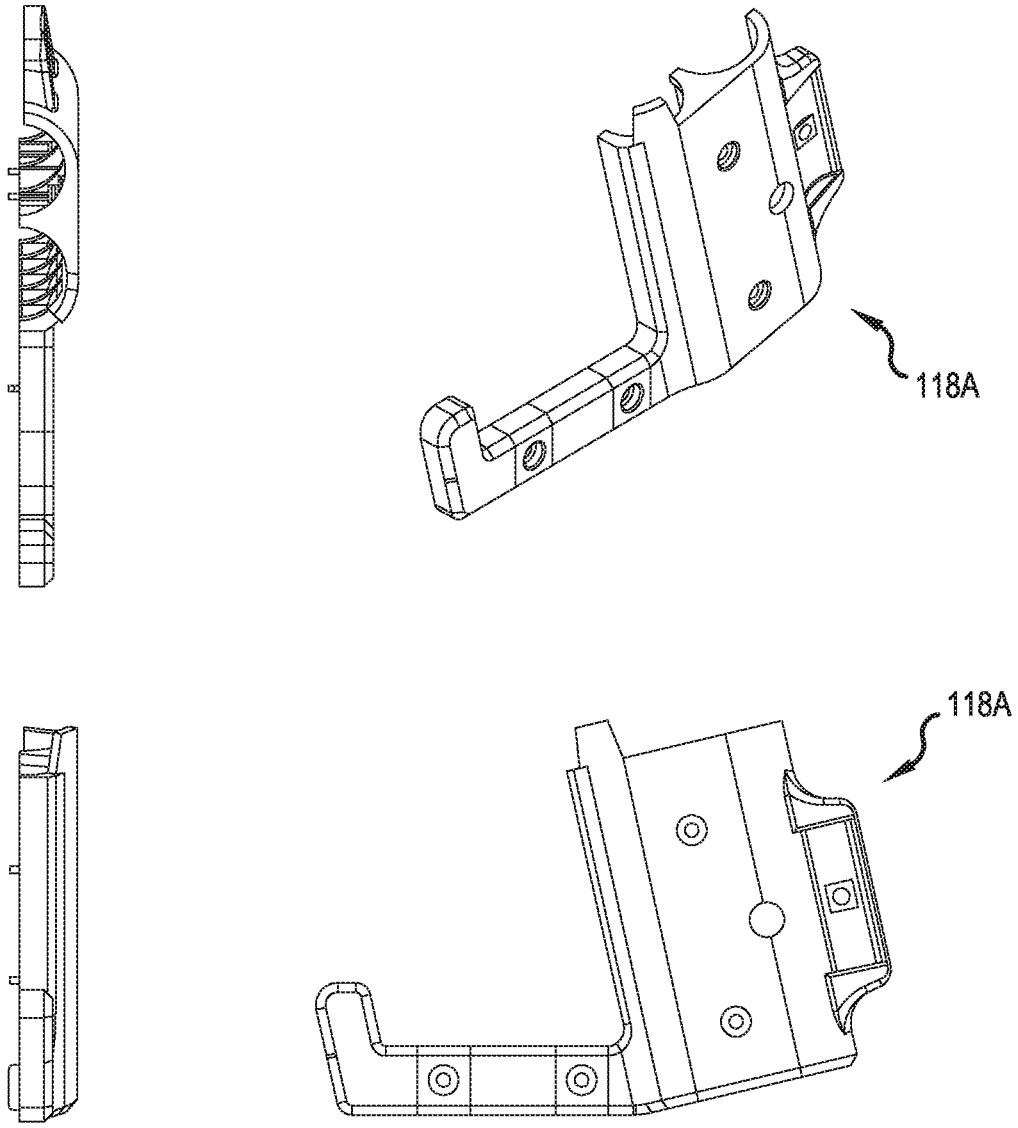
FIGS. 1G-1H illustrate details of parts of a hook of a shade apparatus according to an aspect of an embodiment of the present invention.
Figure 1H:
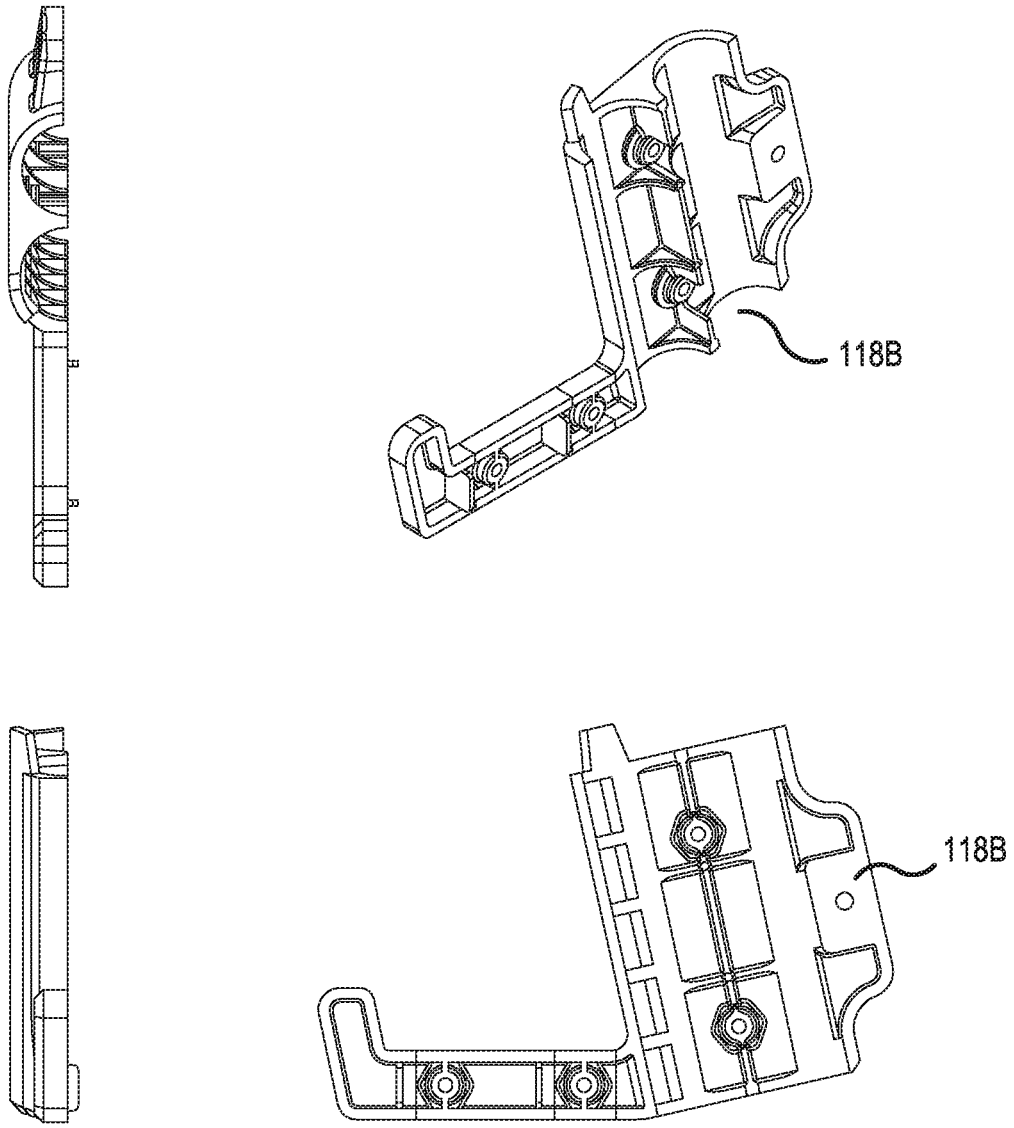
Figure 1I:
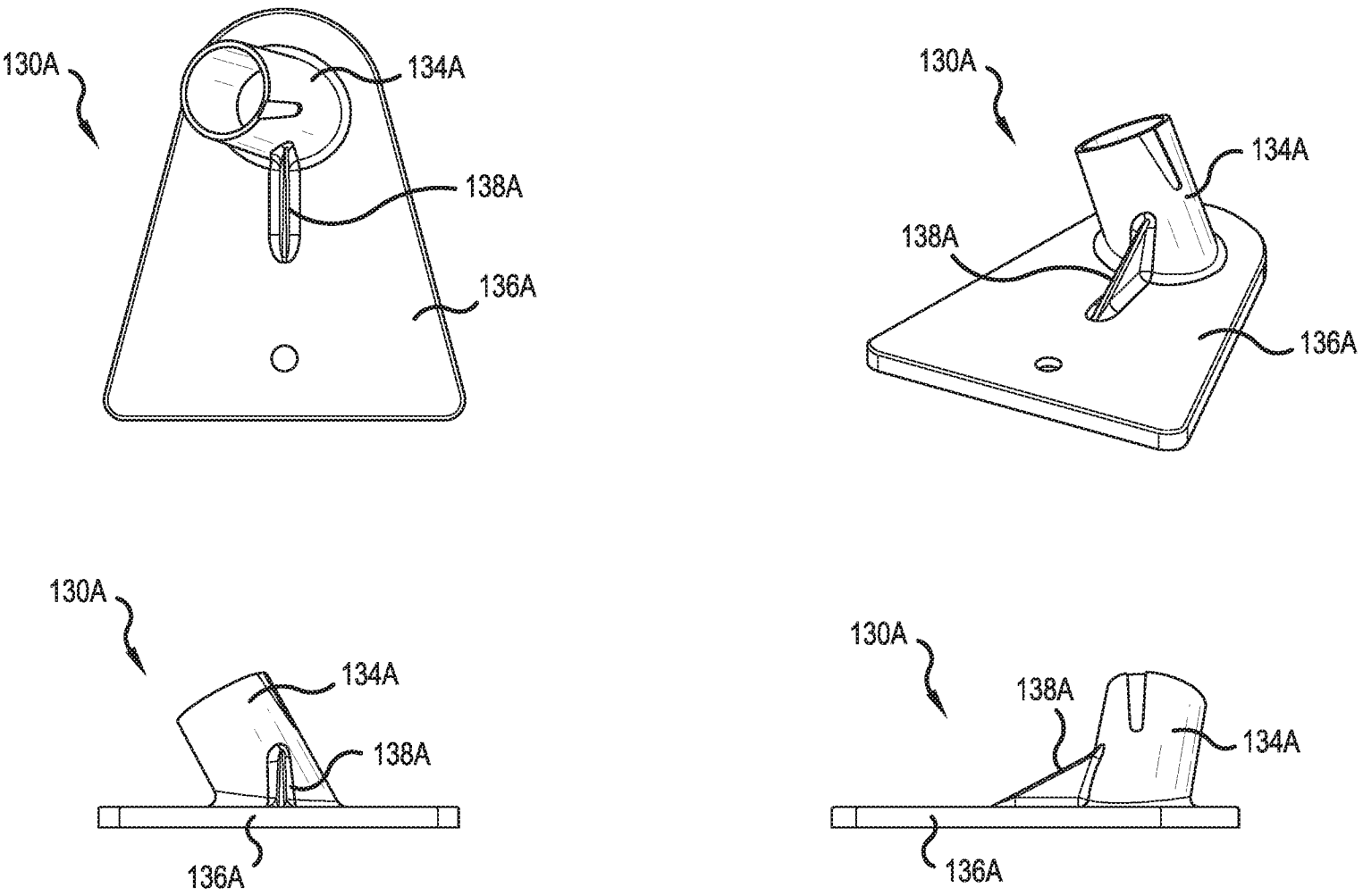
FIGS. 1I-1K illustrate details of tripod feet of a shade apparatus' tripod legs of a shade apparatus according to an aspect of an embodiment of the present invention.
Figure 1J:
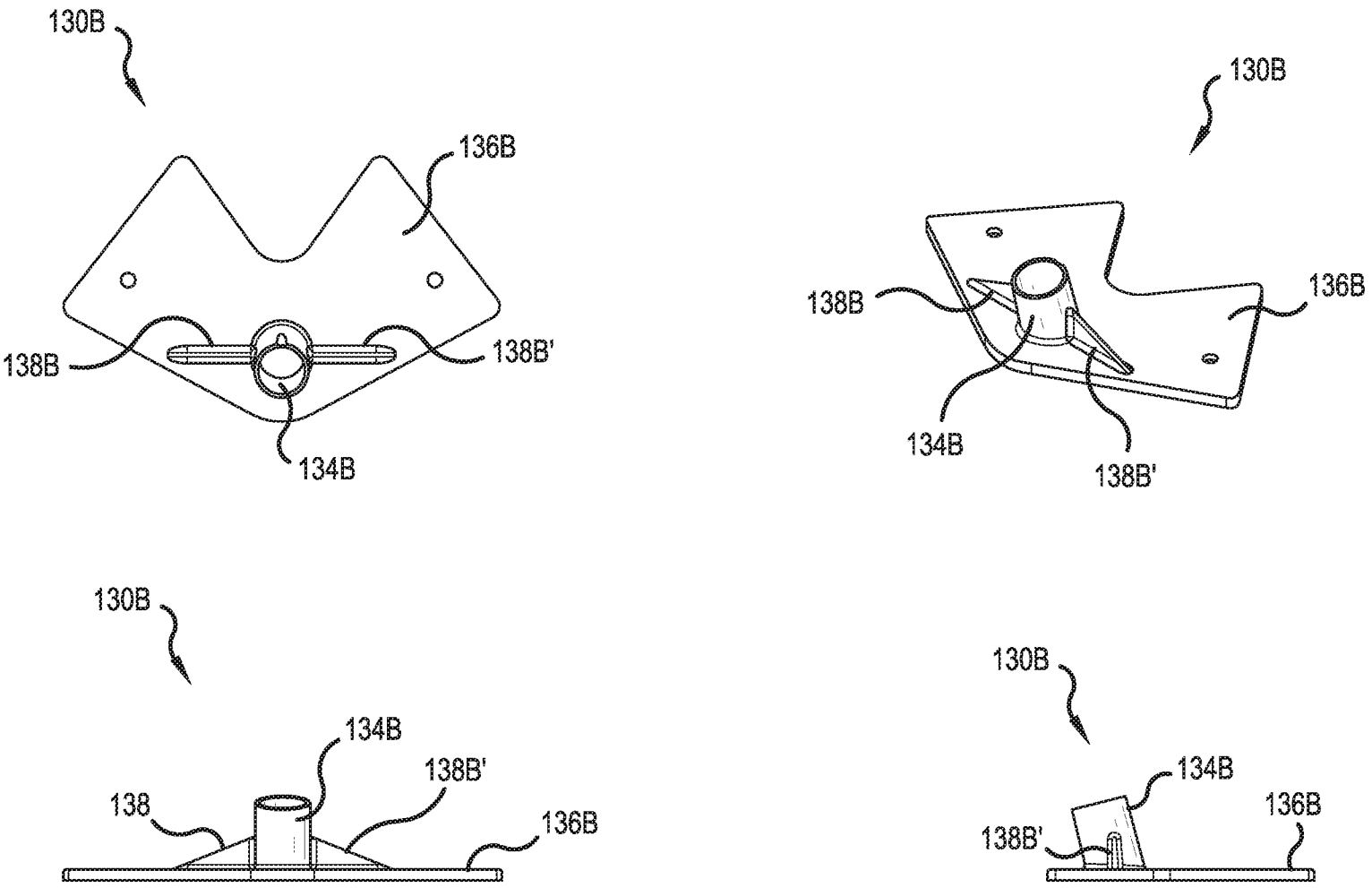
Figure 1K:
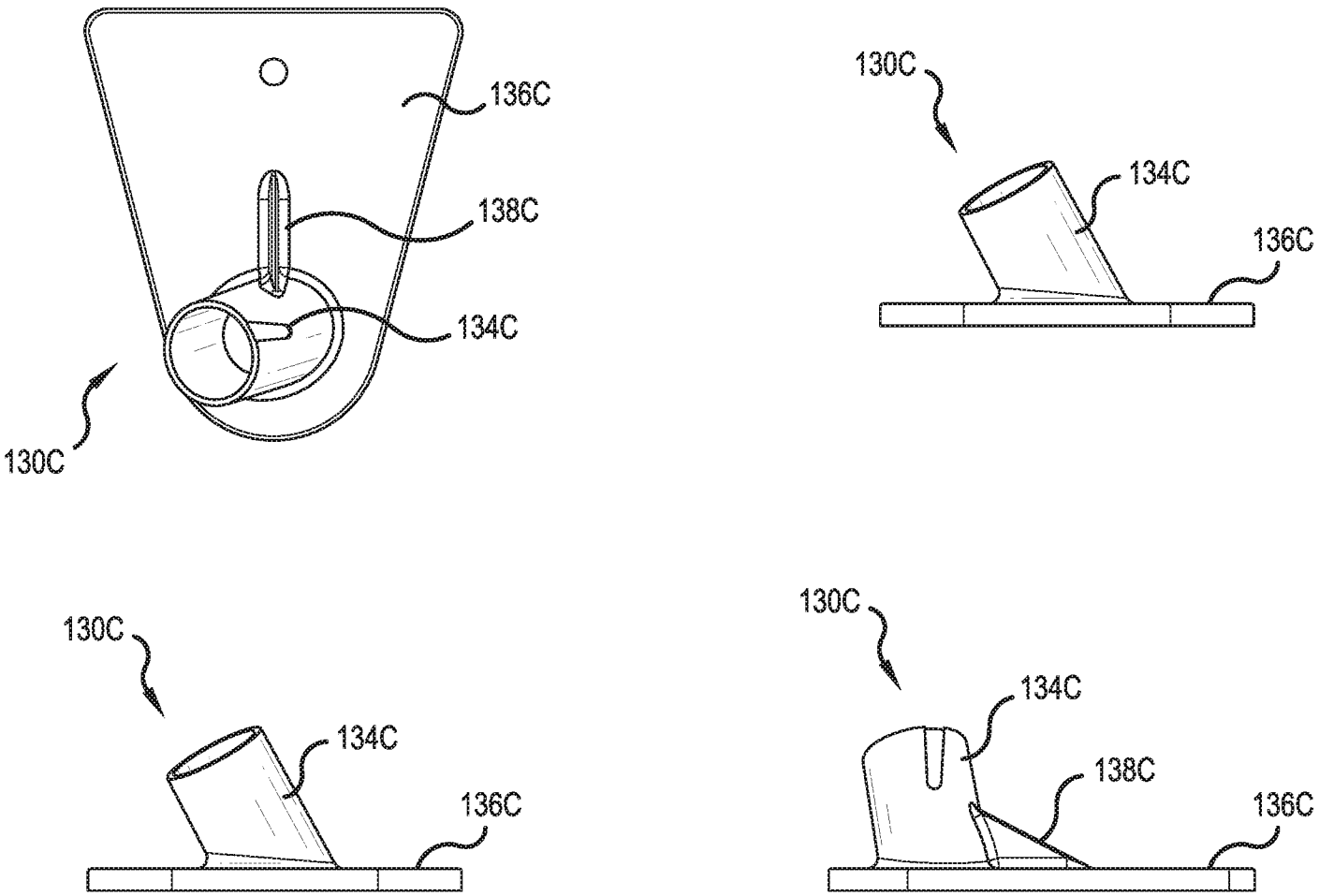

Referring now to FIGS. 1A and 1G-1H shade apparatus 100 is shown having hook 118, according to an aspect of an embodiment of the present invention. In an aspect of an embodiment of the present invention, a hook 118 may extend downward from the base of tripod base 106. Hook 118 may be used for a variety of purposes, including, without limitation, hanging sporting bags, sporting accessories etc.

In one aspect of an embodiment of the present invention, hook 118 may include two mirror halves, 118A and 118B which, may be joined or connected together to function as hook 118. In an aspect of an embodiment of the present invention, hook halves 118A and 118B may be connected together around tripod leg 104C and, as in another aspect of an embodiment of the present invention, first arm 110. In an aspect of an embodiment of the present invention, hook halves 118A and 118B may be connected using a screw or a pair of screws or using any other similar connector as known in the art.

In another aspect of an embodiment of the present invention, junctions 112 and 124 may include locking mechanisms, 120A and 120B respectively for locking each junction in place, while also fixing their respective connected arms in place as well.

In another aspect of an embodiment of the present invention, locking mechanisms 120A and 120B may include any one or more of: collar locks, lever cam locks, flat cam locks, elbow joints or a rotational angle piece.

In another aspect of an embodiment of the present invention, to enable ease in changing the orientation of first and second canvas structures 116A and 116B, junctions 112 and 124 may be capable of moving in multiple directions about different axes. In another aspect, each or any one of junctions 112 and 124 may include a ball rotation joint connected to the elements of each junction in connection with arms 114 and 126. The ball rotation joint may be between or connected to the elements of the respective junction connected to a pole. In an aspect of an embodiment of the present invention, junctions 112 and 124 may make use of elbow joints.

Shade apparatus 100 may also include connector arm 122 connecting second junction 112 with third junction 124. Third junction 124 may also be connected to second canvas arm 126 which is connected to second canvas structure 116B. Both canvas structures 116A and 116B provide shade to users 102A and 102B while the users are performing their activities.

In an aspect of an embodiment of the present invention, shade apparatus 100 may also include support arm 128 connecting first arm 110 with first canvas arm 114. Support arm 128 may provide additional support to first canvas arm 114. In an aspect of an embodiment of the present invention, support arm 128 may have one end connected with first canvas arm 114 at a point between first canvas structure 116A and second junction 112 while its second end may be connected with first arm 110 at a point between second junction 112 and tripod base 106.

In an aspect of an embodiment of the present invention, shade apparatus 100 may include one or more scissor hinge(s) 132, which may connect any two sets of tripod legs 104A, 104B and/or 104C.

Referring now to FIGS. 1A and 1I through 1K, shade apparatus 100 is shown with tripod feet 130A, 130B and 130C according to aspects of embodiments of the present invention. In an aspect of an embodiment of the present invention, tripod feet 130A, 130B and 130C may be positioned at each base of each of tripod legs 104A, 104B and 104C, respectively. Tripod feet 130A, 130B and 130C are structurally designed to generate friction between their respective tripod legs and the surface upon which shade apparatus 100 is placed on. In an aspect of an embodiment of the present invention, tripod feet 130A, 130B and 130C may have the same structure and shape. In another aspect of an embodiment of the present invention, each tripod foot 130A, 130B and 130C may be distinct from one another.

In an aspect of an embodiment of the present invention, each of tripod feet 130A, 130B and 130C may include a sleeve component 134A, 134B and 134C, for receiving tripod feet 130A, 130B and 130C, respectively. In an aspect of an embodiment of the present invention, each of sleeves 134A, 134B and 134C may be connected with a flat portion 136A, 136B and 136C respectively. In an aspect of an embodiment of the present invention, sleeves 134A, 134B and 134C may be angularly connected with flat portion 136A, 136B and 136C, respectively—in which case sleeves 134A, 134B and 134C may be connected with their respective flat portions at an angle to the flat portions.

In an aspect of an embodiment of the present invention, sleeves 134A, 134B and 134C may be further supported by angular wings 138A, 138B, and 138C for additional support of the sleeves. In an aspect of an embodiment of the present invention, one or more of the sleeves may have an additional angular wing such as, for example, angular wing 138B' of sleeve 138.

Referring back to FIG. 1A, shade apparatus 100 is shown having first and second canvas structures 116A and 116B according to aspects of embodiments of the present invention. In an aspect of an embodiment of the present invention, canvas structures 116A and 116B may include a canvas of any shape in along with rods used to maintain the desired shape of the canvas.

First canvas structure 116A may be connected with first canvas arm 114 by way of first canvas structure junction 140A while second canvas structure 116B may be connected with second canvas arm 126 by way of second canvas structure junction 140B. In an aspect of an embodiment of the present invention, any one or more of first canvas structure junction 140A and/or second canvas structure junction 140B, may be multi directional, multi axial, multi angular and multi rotational, capable of moving in multiple directions about different axes.

In another aspect of an embodiment of the present invention, each or both of canvas structures 116A and 116B may be structurally configured to enable the flow of air currents/breeze through the canvas structure to prevent tipping of shade apparatus 100. For instance, canvas structure 116A, 116B may include elevated portions that are elevated using elevation legs that connect a higher positioned portion of canvas structure 116A, 116B above the other portions thereby creating an open space between the different portions of the canvas structure to allow the free flow of air/breeze through the structure.

In an aspect of an embodiment of the present invention, first canvas structure 116A may include a front portion 142A, a mid-portion 142B and a rear portion 142C, where front portion 142A is connected to mid-portion 142B by way of a first set of portion connectors 144A, 144B and mid-portion 142B is connected to rear portion 142C by way of a second set of portion connectors 144C, 144D and where rear portion 144C is connected with first canvas structure junction 140A. In an aspect of an embodiment of the present invention, each of any one or more of first set of portion connectors 144A, 144B, second set of portion connectors 144C, 144D may include two scissor hinges which enable mid-portion 142B to be lifted away from or folded towards front and rear portions 142A, 142C. With mid-portion 142B lifted using the scissor hinges, wind gusts may be enabled to flow through first canvas structure 116A by flowing through the space between mid-portion 142B and front and rear portions 142A and 142C. This would prevent the wind gust from tipping shade apparatus 100 over.

In another aspect of an embodiment of the present invention, each of any one or more of first set of portion connectors 144A, 144B, second set of portion connectors 144C, 144D may include fixed arms that position said mid-portion away from said front and rear portions.

In an aspect of an embodiment of the present invention, second canvas structure 116B may include a front portion 146A, a mid-portion 146B and a rear portion 146C, where front portion 146A is connected to mid-portion 146B by way of a second set of portion connectors 148A, 148B and mid-portion 146B is connected to rear portion 146C by way of a second set of portion connectors 148C, 148D and where rear portion 148C is connected with second canvas structure junction 140B. In an aspect of an embodiment of the present invention, each of any one or more of second set of portion connectors 148A, 148B, second set of portion connectors 148C, 148D may include two scissor hinges which enable mid-portion 146B to be lifted away from or folded towards front and rear portions 146A, 146C. With mid-portion 146B lifted using the scissor hinges, wind gusts may be enabled to flow through second canvas structure 116B by flowing through the space between mid-portion 146B and front and rear portions 146A and 146C. This would prevent the wind gust from tipping shade apparatus 100 over.

In another aspect of an embodiment of the present invention, each of any one or more of second set of portion connectors 148A, 148B, second set of portion connectors 148C, 148D may include fixed arms that position said mid-portion away from said front and rear portions.

Figure 2A:
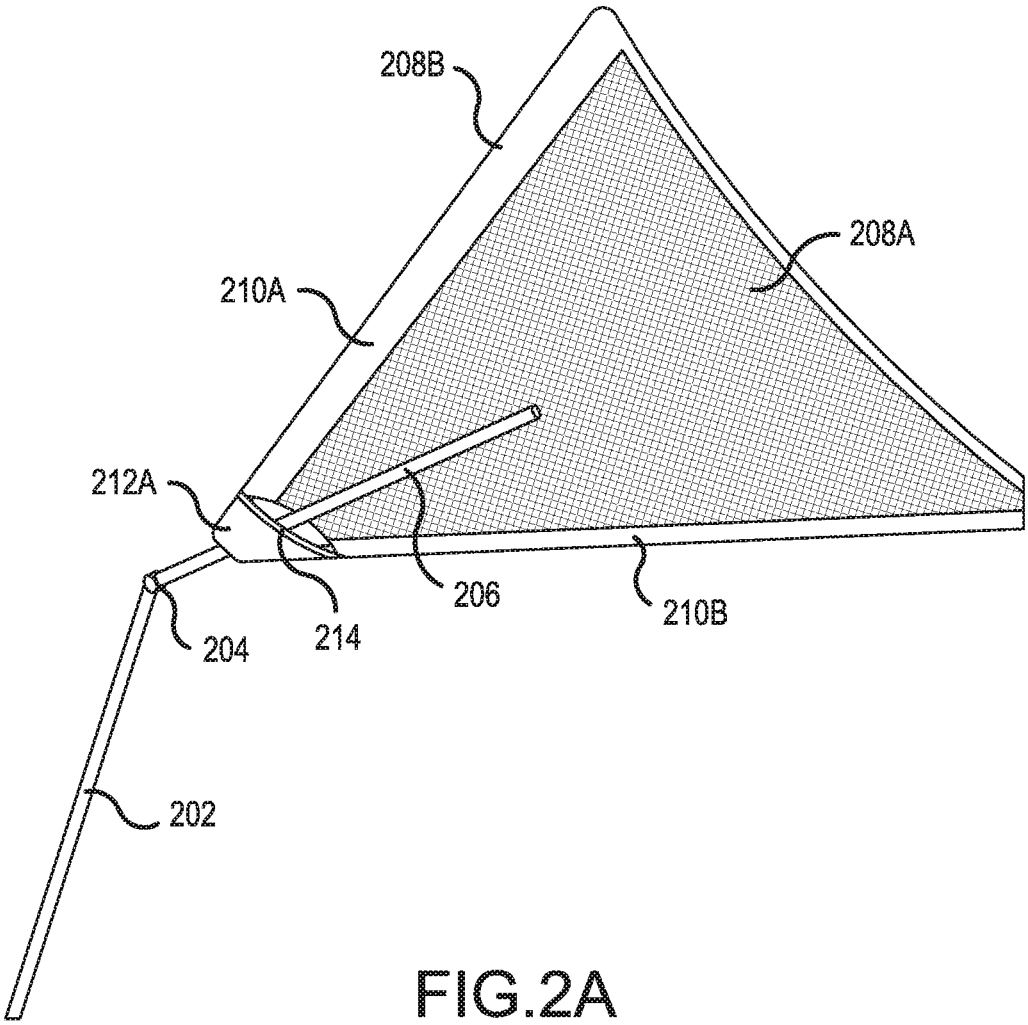
FIGS. 2A-2B illustrate details of a canvas structure of a shade apparatus according to an aspect of an embodiment of the present invention.
Figure 2B:
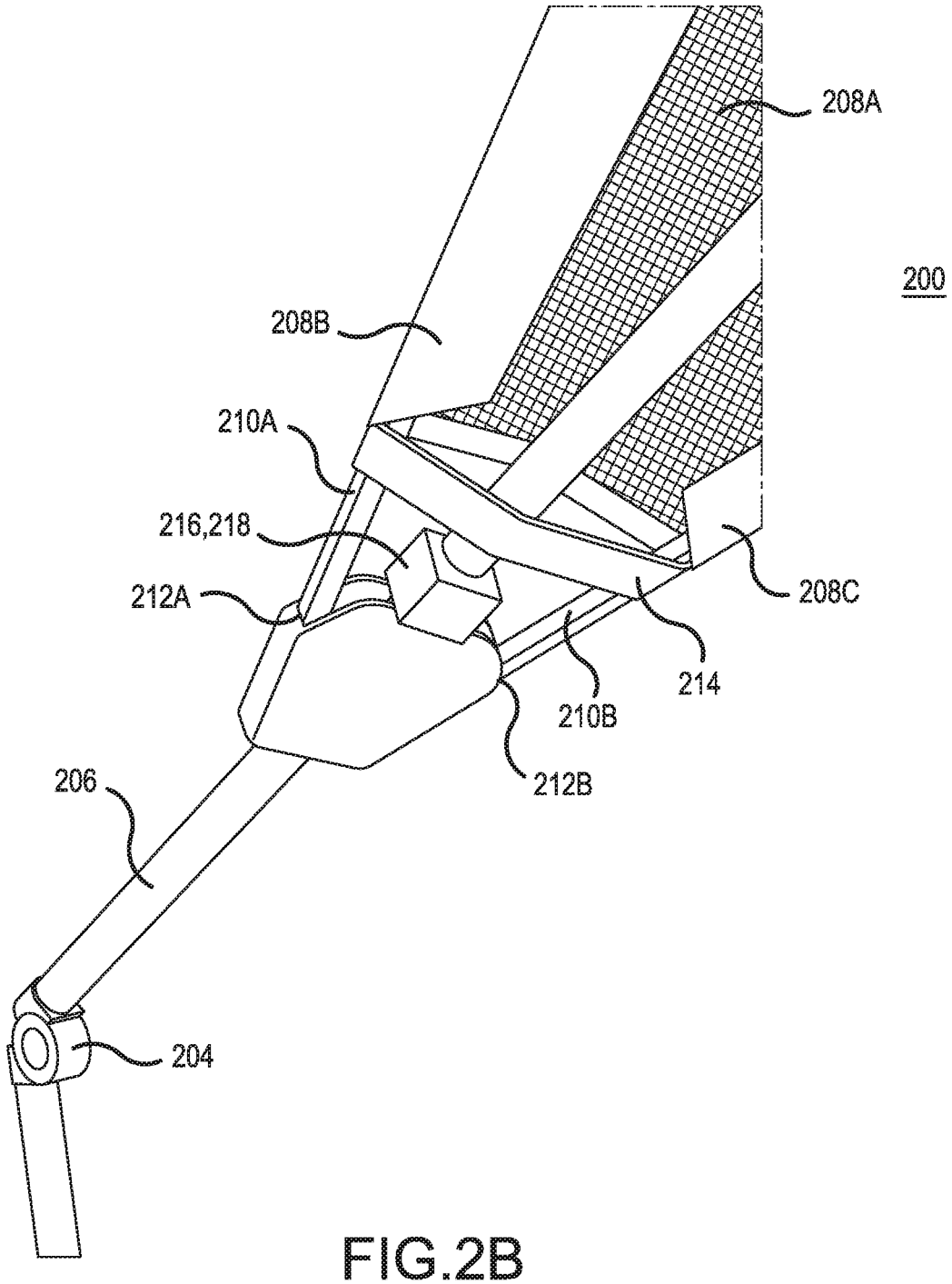

Referring now to FIGS. 2A and 2B, views of canvas structure 208 and junction 216 of shade apparatus 200 are shown according to aspects of embodiments of the present invention. In an aspect of an embodiment of the present invention, canvas structure 208 may include canvas 208A and canvas arms 210A and 210B. In addition to providing shade, canvas 208A may serve as an advertisement panel—enabling entities to place their name or brands on canvas 208A.

In an aspect of an embodiment of the present invention, canvas arms 210A and 210B may comprise of two rods slidably positioned within sleeves 208B and 208C of canvas 208A. Canvas structure 208 may further include a base 212 having two canvas arm receptacles 212A and 212B for removably anchoring each of canvas arms 210A and 210B respectively. In an aspect of an embodiment of the present invention, each receptacle may allow for folding of each arm. In another aspect, canvas structure 208 may include folding mechanism 214 having two arms where each arm is connected to each of canvas arms 210A and 210B. This enables canvas arms 210A and 210B to be folded toward pole 206 when shade apparatus 200 being transported after use.

Canvas structure 208 may be slidably positioned onto arm 206 and may be locked in place using locking mechanism 218 of junction 216. Canvas structure 208 may be held in place, in one aspect, by having the user slide canvas structure 208 onto arm or pole 206 and then placing junction 216 with locking mechanism 218 after canvas structure 208 thereby blocking base 212 and preventing the structure from sliding out.

The invention has been described in detail with particular reference to certain preferred embodiments thereof, but it will be understood that variations and modifications can be effected within the spirit and scope of the invention.

What is claimed is:

1. A shade apparatus comprising:

a tripod arrangement comprising of two front tripod legs, one rear tripod leg and a tripod base, wherein said tripod legs are foldably connected to said tripod base;

a first junction connected to one tripod leg, wherein said first junction comprises of an opening;

a first arm, having first and second ends, wherein said first arm is slidably positioned within said opening of said first junction;

a second junction, wherein said second junction is connected to: said first arm, a first canvas arm and a connector arm;

a support arm connected to said first arm and said first canvas arm;

a third junction, wherein said third junction is connected to: said connector arm and a second canvas arm; and first and second canvas structures; wherein said first canvas structure is connected with said first canvas arm by way of a first canvas structure junction and wherein said second canvas arm is connected with said second canvas arm by way of a second canvas structure junction.

2. The shade apparatus of claim 1 wherein any one of or more of the first, second or third junctions is multi directional, multi axial, multi angular and multi rotational, and/or capable of moving in multiple directions about different axes.

3. The shade apparatus of claim 1 further comprising of a hook removably connected to said rear tripod leg.

4. The shade apparatus of claim 1 wherein any one or more of said: first, second or third junctions comprise of any one or a combination of: collar locks, lever cam locks, flat cam locks, and/or a rotational angle piece which enables rotation of said any one or more of said first, second or third junctions.

5. The shade apparatus of claim 1, wherein the tripod base further comprises of at least one holder for holding user items.

6. The shade apparatus of claim 1 wherein each said tripod leg comprises of a tripod foot, wherein each tripod foot of each tripod leg is any one of the following: distinct from each other, same as each other.

7. The shade apparatus of claim 6 wherein said tripod foot comprises of:

a sleeve for receiving said tripod foot's corresponding tripod leg; and a flat portion connected to said sleeve, wherein said flat portion is angularly connected with said sleeve.

8. The shade apparatus of claim 7 wherein the sleeve and flat portions are connected by way of at least one angular connector.

9. The shade apparatus of claim 1, wherein any one or more of said arms is a pole.

10. The shade apparatus of claim 1, further comprising a scissor hinge connector connecting any two sets of said tripod legs.

11. The shade apparatus of claim 1, wherein any one or more of said first canvas structure junction, second canvas structure junction is multi directional, multi axial, multi angular and multi rotational, and/or capable of moving in multiple directions about different axes.

12. The shade apparatus of claim 1, wherein any one or more of said first and second canvas structures comprises of a front portion, a mid-portion and a rear portion, wherein said front portion is connected to said mid-portion by way of a first set of portion connectors and wherein said mid-portion is connected to said rear portion by way of a second set of portion connectors and wherein said rear portion of said first canvas structure is connected with said first canvas structure junction, and wherein said rear portion of said second canvas structure is connected with said second canvas structure junction.

13. The shade apparatus of claim 1, wherein said first set of portion connectors comprises of two fixed arms that position said mid-portion away from said front and rear portions.

14. The shade apparatus of claim 1, wherein said second set of portion connectors comprises of two fixed arms that position said mid-portion away from said front and rear portions.

* * * * *